US009157461B2

(12) United States Patent
Mehling et al.

(10) Patent No.: US 9,157,461 B2
(45) Date of Patent: Oct. 13, 2015

(54) DIGITAL HYDRAULICS VALVE STAGE

(75) Inventors: Hermann Mehling, Karlstadt-Stetten (DE); Daniel Weiler, Niedernberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/508,600

(22) PCT Filed: Nov. 4, 2010

(86) PCT No.: PCT/EP2010/006726

§ 371 (c)(1),
(2), (4) Date: Jul. 30, 2012

(87) PCT Pub. No.: WO2011/054518

PCT Pub. Date: May 12, 2011

(65) Prior Publication Data

US 2012/0286180 A1 Nov. 15, 2012

(30) Foreign Application Priority Data

Nov. 9, 2009 (DE) ..... 10 2009 052 285

(51) Int. Cl.
*F17D 1/00* (2006.01)
*F15B 11/042* (2006.01)

(52) U.S. Cl.
CPC ..... *F15B 11/0426* (2013.01); *F15B 2211/351* (2013.01); *F15B 2211/40576* (2013.01); *F15B 2211/40592* (2013.01); *Y10T 137/87314* (2015.04); *Y10T 137/87772* (2015.04)

(58) Field of Classification Search
CPC ..... G05D 7/0652
USPC ..... 137/599.01, 599.04, 599.05, 599.06, 137/599.07, 601.14; 251/129.05
See application file for complete search history.

(56) References Cited

U.S. PATENT DOCUMENTS 4,170,245 A 10/1979 Haley
4,313,465 A * 2/1982 Holzem et al. ..... 137/599.07
4,518,011 A * 5/1985 Stoll ..... 137/596.17
5,150,690 A * 9/1992 Carter et al. ..... 123/527

(Continued)

FOREIGN PATENT DOCUMENTS

FR 2 880 143 A1 6/2006
WO 02/086327 A1 10/2002

OTHER PUBLICATIONS

International Search Report corresponding to PCT Application No. PCT/EP2010/006726, mailed Mar. 8, 2011 (German and English language document) (5 pages).

*Primary Examiner* — Kevin Murphy
*Assistant Examiner* — R. K. Arundale
(74) *Attorney, Agent, or Firm* — Maginot, Moore & Beck LLP

(57) ABSTRACT

A digital hydraulics valve includes a plurality of digitally switchable individual valves, which are connected in parallel with respect to a load, and at least one equalizing valve for generating intermediate values between the opening cross-section stages that can be implemented by the digitally switchable individual valves. The equalizing valve is a poppet valve, which provides a partial opening cross-section smaller than the nominal opening cross-section thereof by actuation using a time switching pattern. The time switching pattern is preferably based on the principle of a pulse width modulation. The equalizing valve is further preferably a valve selected from the plurality of individual valves of the digital hydraulics valve.

10 Claims, 3 Drawing Sheets

(56) References Cited

U.S. PATENT DOCUMENTS 5,329,965 A * 7/1994 Gordon ..... 137/599.07
6,089,533 A * 7/2000 Bubeck et al. ..... 251/75
6,234,204 B1 * 5/2001 van den Wildenberg ..... 137/599.07
6,729,601 B2 * 5/2004 Freisinger et al. ..... 251/129.05
6,997,202 B2 * 2/2006 Olander ..... 137/2

* cited by examiner

DIGITAL HYDRAULICS VALVE STAGE

This application is a 35 U.S.C. §371 National Stage Application of PCT/EP2010/006726, filed on Nov. 4, 2010, which claims the benefit of priority to Serial No. DE 10 2009 052 285.9, filed on Nov. 9, 2009 in Germany, the disclosures of which are incorporated herein by reference in their entirety.

BACKGROUND

The present disclosure relates to a digital hydraulic valve stage having a sub-digit accuracy function and in particular a digital hydraulic valve.

A consumer is controlled in a digital hydraulic valve stage by means of one or a plurality of parallel arrangement(s) of one or a plurality of switching valve(s). One or a plurality of proportional valve(s) is/are typically replaced by this/these arrangement(s). A parallel arrangement of this type of a plurality of switching valves is described by the relevant scientific world as a digital hydraulic valve.

The individual switching valves of the digital hydraulic valve are typically characterized by two switching positions, namely open and closed. Accordingly, the through-flow of a digital hydraulic valve of this type that can be achieved thereby is a result approximately of the total of the (individual) through-flows of the currently open individual switching valves (also referred to as individual valves). Different magnitudes of through-flow can be achieved by selectively opening and closing the individual valves, which through-flow follow, one after the other, a specific characteristic curve of the digital hydraulic valve as illustrated in the attached FIG. 1B.

FIG. 1B illustrates the (stepped) correcting variables/through-flow characteristic curve of a digital hydraulic valve that is typically achieved. By way of comparison, FIG. 1A likewise illustrates a corresponding (continuous) characteristic curve of an analog proportional valve. The maximum number of through-flow openings illustrated in FIG. 1B and/or the self adjusting values for the respective difference through-flow openings dQ in the case of a digital hydraulic valve is also described as quantization. However, this quantization represents a disadvantageous limitation for control procedures, since the correcting variables/through-flow characteristic curve of a digital hydraulic valve always represents only a more or less close approximation to the continuous characteristic curve of a proportional valve. The limitation is consequently reflected in the control quality, i.e. the deviation of the actual values of said variables (actual values) from the desired values (setpoint values).

A fundamental option of improving said control quality of the digital hydraulic valve resides in reducing the intervals between the dQ steps illustrated in FIG. 1B. These intervals can be reduced in the simplest manner by increasing the number of individual valves and thus increasing the number of dQ steps. However, this results in complex digital hydraulic valves that are not only expensive and voluminous but are also extremely susceptible to faults. As an alternative or in addition thereto, there is also the option of maintaining the through-flow openings in the individual valves in different magnitudes in order in this manner to come closer to a specific characteristic curve.

A control system of this type and also a method for controlling a consumer by means of a number of parallel-connected switching valves have been disclosed in the prior art, for example in accordance with WO 02/08 63 27 A1, wherein said valves are combined to form a digital hydraulic valve of this generic type and are digitally controlled.

On the basis of this prior art, the object of the present disclosure is to provide a digital hydraulic valve of this generic type that has a substantially continuous or almost continuous Q/V characteristic curve, but does not require the arrangement of a high number of individual valves.

This object is achieved by means of a digital hydraulic valve as described herein.

SUMMARY

The fundamental idea of the invention resides substantially in operating an individual valve selected from a plurality of individual valves of a digital hydraulic valve of the generic type or an additional compensating valve in a state that is atypical with respect to the digital hydraulic valve. In other words, in accordance with the invention, in the case of a digital servo valve circuit (digital hydraulic valve) the digitally switchable switching valves (preferably seating valves), by means of which an entire opening cross section of the digital servo valve circuit is adjusted in stages or steps as inherent to its functional principle (see aforementioned explanations), a proportionally adjustable valve is provided, which proportionally adjustable valve forms the compensating valve. This proportionally adjustable valve preferably comprises a maximum through-flow in the order of magnitude of the smallest or second smallest switching valve of the digital servo valve circuit. By arranging the proportionally adjustable valve, it is now possible to achieve more accurate interim values between the individual opening cross section stages (i.e. the dQ steps in accordance with FIG. 1B) and thus to control the position, rate or pressure electro-hydraulically in a more precise manner. This effect is described hereinunder as the sub-digit accuracy function.

Although the digital hydraulic valve that is equipped with the additional proportionally adjustable valve for achieving interim values between two adjacent opening cross section curves comprises a correcting variables/through-flow characteristic curve that is extremely close to the characteristic curve of a comparable proportionally adjustable valve, the additional proportionally adjustable valve requires additional installation space and also increases the complexity of the entire system.

For this reason, the disclosure provides in an advantageous manner to embody the aforementioned generally described as a proportionally adjustable valve and/or the compensating valve, which is described as making the dQ steps uniform, — in accordance with the digitally switchable individual valves — as a switching valve, preferably as a seating valve, that by means of a control process according to a timing-circuit diagram (e.g. according to the principle of pulse width modulation (PWM)) provides a partial opening cross section that is smaller than its nominal opening cross section. This then creates the option in accordance with an advantageous embodiment of the subject of the disclosure to select the seating valve that is controlled according to the timing-circuit diagram from the plurality of individual valves of the digital hydraulic valve. In this manner, a sub-digit accuracy function in accordance with the aforementioned definition can be allocated to the digital hydraulic valve without having to provide an additional valve.

Preferably, the selected individual valve concerned is the individual valve selected from the plurality of individual valves of the digital hydraulic valve that has the smallest or second smallest nominal through-flow.

An advantageous embodiment of the disclosure can provide that the selected individual valve is duplicated in the digital hydraulic valve, wherein one of the valves is then digitally operated and the other individual valve is operated in an atypical manner. In this manner, any individual valve can be used for creating the dQ steps, wherein the digital hydraulic valve is only insignificantly enlarged.

It is of further advantage to control the selected individual valve by means of PWM amplifier electronics and to provide for this purpose a PWM fundamental frequency that is preferably approximately half as high as the maximum switching frequency of the selected individual valve. This has the advantage that in the case of this PWM frequency being selected the degree to which the atypically operated seating valve opens follows the PWM switched-on duration in an almost linear manner over a wide range of its characteristic curve.

BRIEF DESCRIPTION OF THE DRAWINGS

The disclosure is explained in detail hereinunder with the aid of a preferred exemplary embodiment with reference to the attached drawings, in which.

DETAILED DESRIPTION

Figure 2:
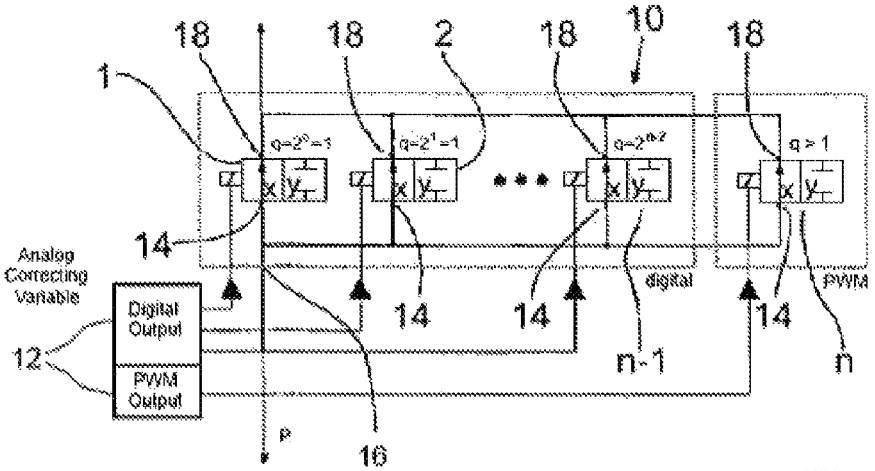
FIG. 2 shows the principle structure of the circuit of a digital hydraulic valve in accordance with a preferred exemplary embodiment of the disclosure.

A digital hydraulic valve 10 illustrated schematically in FIG. 2 and in accordance with a preferred exemplary embodiment of the disclosure comprises a plurality (number n) of 2/2 directional control valves 1 to n (hereinunder referred to as digital switching valves) that are actuated electro-magnetically and for this purpose (their respective electro-magnet) are connected to the digital output of a control electronics 12. Each of the digital switching valves 1 to n has a fluid inlet 14, which is connected in this case to a pump connection 16 (or tank connection 20 in accordance with FIG. 5), and a fluid outlet 18, which is connected to a consumer line A. The digital switching valves 1 to n are arranged in a fluid-technical manner in parallel with each other and can in each case only be switched over between two switching positions x, y. In a first switching position x of each digital switching valve 1 to n, a valve slide fully opens a connection between the pump connection 16 (or tank connection 20 in accordance with FIG. 5) and the consumer line A and in a second switching position y of each switching valve 1 to n the respective valve slide completely closes the connection between the pump connection 16 (or tank connection 20 in accordance with FIG. 5) and the consumer line A.

One of the switching valves 1 to n of the digital hydraulic valve 10 is selected as a compensating valve n. This compensating valve n preferably has the identical structure as the other digital switching valves 1 to n−1, which can in principle be embodied as seating valves. The individual valves 1 to n−1 can in this context have different through-flow cross sections, wherein the through-flow cross section of the compensating valve n corresponds to the individual valve that has the smallest or second smallest through-flow cross section. As an alternative thereto, the through-flow cross section of the compensating valve n can, however, also amount to 1 to 2 times the individual valve that has the smallest through-flow cross section.

Figure 1A:
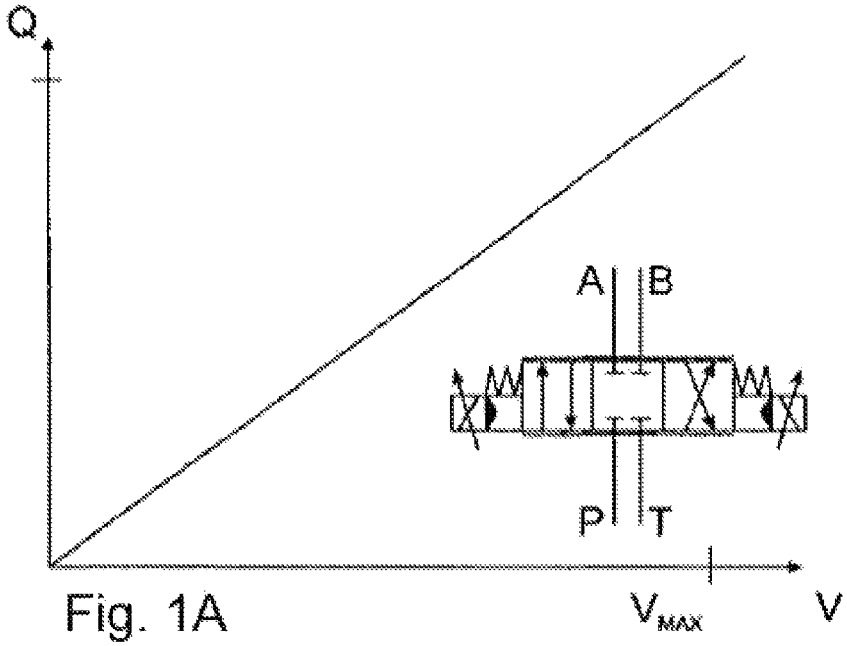
Fig. 1A (Prior Art)
FIGS. 1A and 1B show by way of example the Q/V characteristic curves for a constant drop in pressure over an analog proportional valve (FIG. 1A) in comparison to a digital hydraulic valve (FIG. 1B) in accordance with the prior art.
Figure 1B:
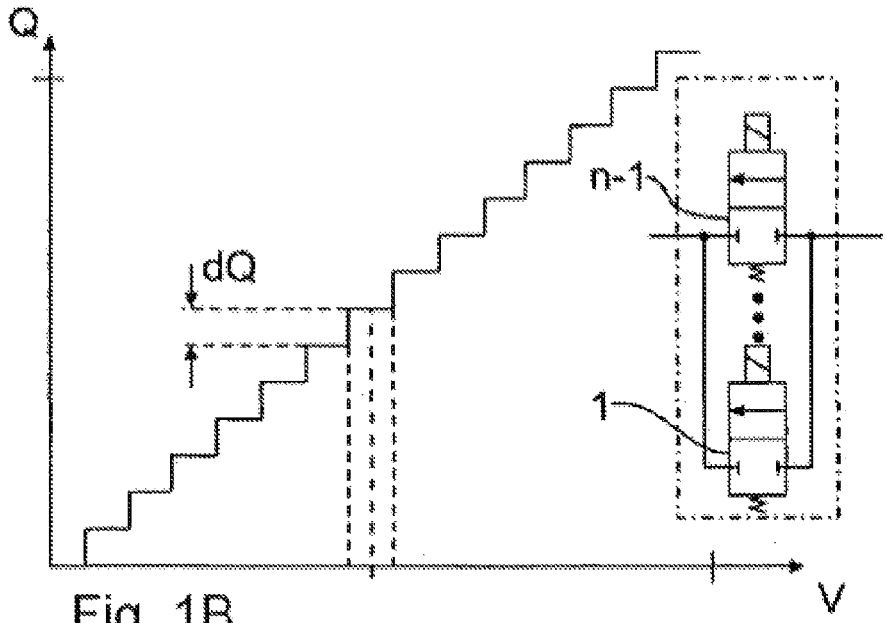
Fig. 1B (Prior Art)

In addition, the compensating valve n can likewise be actuated electro-magnetically, wherein its electro-magnet in this case is, however, connected to a PWM-output (pulse width modulation output) of the control electronics 12. Reference is made, at this point, to the fact that this output of the control electronics 12 controls the compensating valve n according to a specific or pre-determinable timing-circuit diagram that can also be different to the favored pulse width modulation (PWM). In the case of this structure and in comparison to a purely digital servo valve circuit having the identical number of individual valves, a binary digit is omitted, as a consequence of which the step intervals of the dQ steps in accordance with FIG. 1B are longer. However, this is more than compensated for by virtue of the greater resolution of the PWM-controlled switching valve n. In addition, in place of the aforementioned, possibly different, opening cross sections of the individual valves 1 to n−1, it is possible to connect different throttles or adaptor nozzles upstream of the individual valves 1 to n−1, which throttles or adaptor nozzles can be larger in comparison to the prior art, as a consequence of which the system taken as a whole is more robust.

As an alternative to providing the selected individual valve as a compensating valve n, the compensating valve can also be a proportional valve or a switching valve n+1 that is arranged (separately) in addition to the individual valves 1 to n of the digital hydraulic valve 10, which proportional valve or switching valve has been especially embodied for this purpose in the digital hydraulic valve 10 in addition to the already available digital switching valves 1 to n and consequently represents almost a duplicate of another digital switch valve of the same structure and through-flow cross section. In this case, the relevant digital switching valve n is operated by means of the digital output of the control electronics 12, whereas the duplicated (structurally identical) switching valve n+1 is operated, for example, by means of the PWM output of the control electronics 12 in an atypical state. Consequently, it is possible, for example, to digitally switch the digital hydraulic valve 10 in the normal operation into the state "(slightly) too slow" and to control the additional switching valve n+1 specifically (preferably by means of the PWM control process) so that it balances out the remaining difference. This method of control is moreover naturally also provided in the case of the aforementioned variant having the compensating valve n selected from the plurality of individual valves 1 to n.

Figure 4:
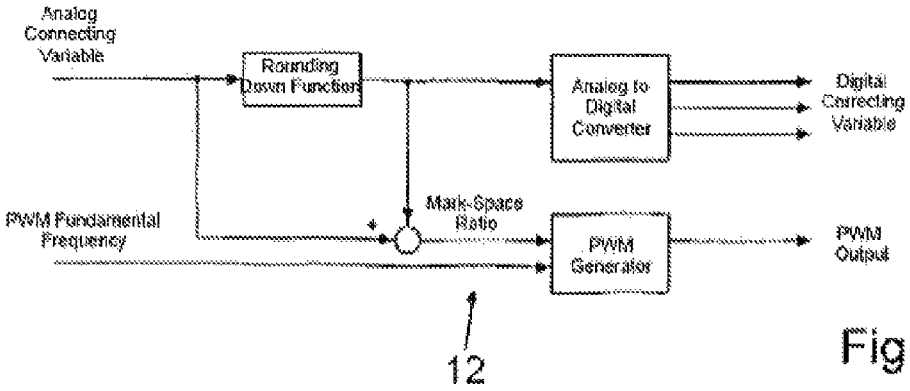
FIG. 4 shows a diagram of an analog to digital conversion by means of a PWM operation in accordance with the disclosure.

FIG. 4 illustrates a schematic diagram of an analog to digital conversion by means of a corresponding PWM operation in order to visually illustrate the aforementioned control method. Accordingly, an analog correcting variable, for example a specific voltage value, is input into the electronics 12, which value is rounded down to the nearest integer value. This integer correcting variable is converted in an A/D convertor to a digital correcting variable and supplied to the digital hydraulic valve 10. As a consequence, the digital hydraulic valve 10 changes into said operating state "(slightly) too slowly". In parallel thereto, the original analog correcting variable is reduced by the analog correcting variable that corresponds to the digital correcting variable, whereby as a consequence a difference correcting variable is produced that determines the control quality of the digital control process. This difference correcting variable is therefore converted according to the PWM principle into a mark-space ratio or also a duty cycle for a predetermined PWM fundamental frequency and supplied to a PWM generator.

It is further possible by means of the above described use of the PWM operation not to duplicate the "smallest" individual valve but rather to duplicate a valve with a greater through-flow. If this option is selected, then the combinations of the digital correcting variable overlap. In order, for example, to represent the analog correcting variable 2.1 digitally/PWM controlled, the following signals would therefore be possible:

digital correcting variable: 2 and PWM value: 0.1 or digital correcting variable: 1 and PWM value: 1.1

The advantage of this embodiment resides in the fact that it renders it possible to convert a so-called hysteresis, which produces a comparatively smaller number of switch-overs of the individual valves. In the latter mentioned embodiment with regard to the magnitude of the through-flow opening for the compensating valve, it would consequently be possible to illustrate a fluctuation of the analog correcting variable between 0.9 and 1.1 merely by changing the PWM value. It is not necessary then to change the digital correcting variable.

Figure 3:
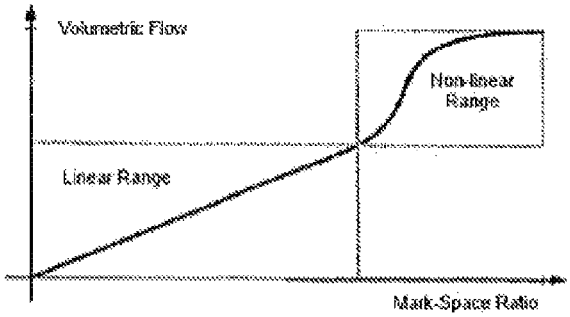
FIG. 3 shows the volumetric flow versus mark—space ratio characteristic curve of a PWM-operated seating valve in accordance with the disclosure.

As has already been mentioned above, a seating valve is preferably provided for the PWM-controlled valve n, which seating valve is connected to the PWM amplifier electronics 12, whereas the digitally switched individual valves 1 to n−1 (which are preferably likewise embodied as seating valves) are controlled by means of a comparator circuit and circuit logic. The PWM fundamental frequency is in this case approximately half as high as the maximum switching frequency. In the case of this PWM frequency being selected, the degree to which the compensating valve n is opened follows the PWM switched-on duration in an almost linear manner over a wide range of its characteristic curve, as illustrated in FIG. 3.

In the case of particularly short switched-on durations, the compensating valve n accordingly behaves in a ballistic manner, i.e. the valve piston opens in short intervals without arriving at its upper end position (fully open contact point) and falls back on the seat. In the case of longer switched-on durations, the valve piston then arrives at its upper end position and only falls back after a short dwell period. This phase corresponds approximately to a pulse width modulation of the opening cross section, i.e. of the averaged fluid through-flow. In the case of still longer switched-on durations, the compensating valve n behaves in an inverse ballistic manner, i.e. during the switched-off duration the piston falls back only for a short distance in the direction towards the valve seat but it no longer arrives at said valve seat. As illustrated in FIG. 3, this range of the characteristic curve is, however, no longer linear and therefore cannot easily be used for the control process in accordance with the disclosure since the valve piston can only slightly influence the opening cross section close to its upper end position.

Figure 5:
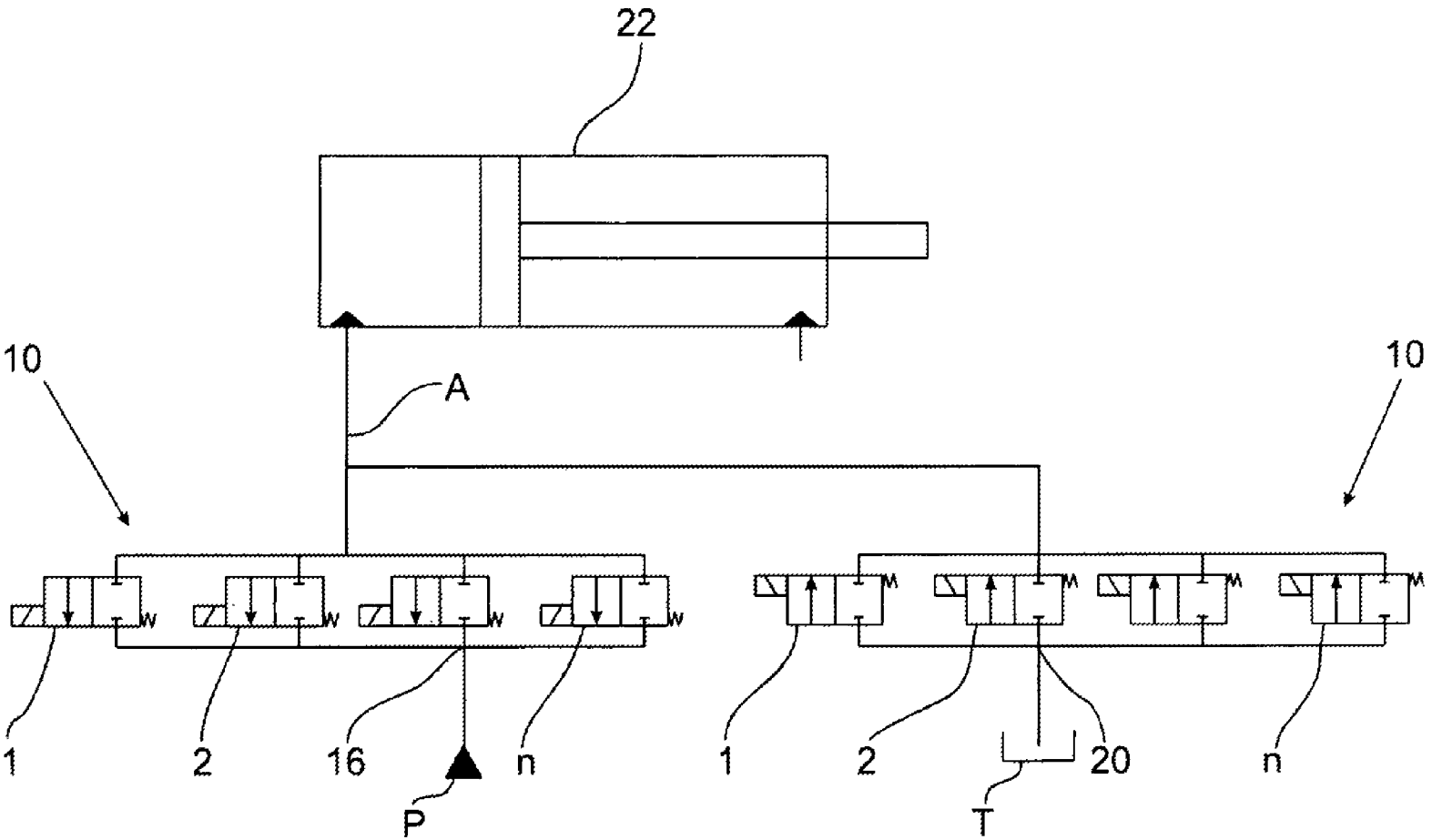
FIG. 5 shows the principle partial structure of a hydraulic system for operating a consumer, preferably a cylinder using digital hydraulic valves in accordance with the disclosure. 10

Finally, FIG. 5 illustrates an example of how the digital hydraulic valve 10 in accordance with the aforementioned construction can, in principle, be installed. Accordingly, two of the digital hydraulic valves 10 in accordance with the disclosure are connected upstream of a consumer 22, preferably a hydraulic cylinder, of which one digital hydraulic valve is fluid connected to a pressure medium source P, for example a pump, and the other digital hydraulic valve is fluid connected to a pressure medium tank T and the consumer 22 is connected thereby to the pressure medium source P or the tank T in the selected manner.

LIST OF REFERENCE NUMERALS

1-*n* Digital switching valves (2/2 directional-control valves)
10 Digital hydraulic valve
12 Control electronics
14 Switching valve inlet
16 Pump connection
18 Switching valve outlet
A Consumer line
20 Tank connection
x,y Switching positions of the valve slide
22 Consumer
P Pressure medium source
T Pressure medium tank

The invention claimed is:

1. A digital hydraulic valve, comprising:

a plurality of digitally switchable individual valves that are connected in parallel with respect to a consumer, each of the digitally switchable valves having a through-flow cross section of a first size or greater and being configured to be selectively opened and closed in accordance with digital control signals;

at least one compensating valve connected in parallel to the plurality of digitally switchable individual valves and having a through-flow cross section of at least the first size, the at least one compensating valve being configured to be opened and closed in accordance with a PWM signal to produce through-flow rates that are equivalent to through-flow rates produced by valves having through-flow cross sections less than the first size; and a controller configured to generate the digital control signals and the PWM signal, the controller being configured to generate the PWM signal such that the PWM signal has a duty cycle within a range from a first duty cycle to a second duty cycle, the second duty cycle being larger than the first duty cycle, wherein the compensating valve is configured to operate in the first duty cycle in such a manner that the compensating valve alternates in short intervals between a fully closed position and a first position between the fully closed position and a fully open position without arriving at the fully open position, wherein the duty cycle includes an intermediate duty cycle between the first and second duty cycles at which the compensating valve is configured to operate in such a manner that the compensating valve alternates at a predetermined frequency between the fully closed position and the fully open position, and wherein the compensating valve is a two-way two-position switching valve having a predetermined maximum switching frequency.

2. The digital hydraulic valve as claimed in claim 1, wherein the compensating valve is operated with the PWM signal at the predetermined frequency, which is approximately half of the predetermined maximum switching frequency of the compensating valve.

3. The digital hydraulic valve as claimed in claim 2, wherein the compensative valve is configured to operate in the second duty cycle in such a manner that the compensating valve alternates in short intervals between the fully open position and a second position between the fully open position and the fully closed position without arriving at the fully closed position.

4. A digital hydraulic valve comprising:

a plurality of digitally switchable individual valves that are connected in parallel with respect to a consumer, each of the digitally switchable valves having a through-flow cross section of a first size or greater and being configured to be selectively opened and closed in accordance with digital control signals, the plurality of digitally switchable valves including a compensating valve selected from the plurality of digitally switchable individual valves connected in parallel to the other valves of the plurality of digitally switchable individual valves and having a through-flow cross section of at least the first size, the at least one compensating valve being configured to be opened and closed in accordance with a PWM signal to produce through-flow rates that are equivalent to through-flow rates produced by valves having through-flow cross sections less than the first size; and a controller configured to generate the digital control signals and the PWM signal, the controller being configured to generate the PWM signal such that the PWM signal has a duty cycle within a range from a first duty cycle to a second duty cycle, the second duty cycle being larger than the first duty cycle, wherein the compensating valve is configured to operate in the first duty cycle in such a manner that the compensating valve alternates in short intervals between a fully closed position and a first position between the fully closed position and a fully open position without arriving at the fully open position, wherein the duty cycle includes an intermediate duty cycle between the first and second duty cycles at which the compensating valve is configured to operate in such a manner that the compensating valve alternates at a predetermined frequency between the fully closed position and the fully open position, and wherein the compensating valve is a two-way two-position switching valve having a predetermined maximum switching frequency.

5. The digital hydraulic valve as claimed in claim 4, wherein the compensating valve is an individual valve selected from the plurality of digitally switchable individual valves of the digital hydraulic valve that has the smallest or second smallest nominal through-flow.

6. The digital hydraulic valve as claimed in claim 4, wherein the compensating valve has a maximum opening cross section that amounts to 1 to 2 times the opening cross section of an individual valve of the plurality of digitally switchable individual valves that has the smallest nominal through-flow.

7. The digital hydraulic valve as claimed in claim 4, wherein:

the plurality of digitally switchable individual valves includes two potential compensating valves, and one potential compensating valve is digitally operated and the other potential compensating valve is operated as the compensating valve in an atypical manner according to the PWM signal.

8. A compensating valve for a digital hydraulic valve, comprising:

a switchable valve configured to be opened and closed in accordance with a PWM signal; and a controller configured to generate the PWM signal, the controller being configured to generate the PWM signal such that the PWM signal has a duty cycle within a range from a first duty cycle to a second duty cycle, the second duty cycle being larger than the first duty cycle, wherein the compensating valve is configured to operate in the first duty cycle in such a manner that the compensating valve alternates in short intervals between a fully closed position and a first position between the fully closed position and a fully open position without arriving at the fully open position, wherein the duty cycle includes an intermediate duty cycle between the first and second duty cycles at which the compensating valve is configured to operate in such a manner that the compensating valve alternates at a predetermined frequency between the fully closed position and the fully open position, and wherein the switchable valve is a two-way two-position switching valve having a predetermined maximum switching frequency.

9. The valve of claim 8, wherein the compensating valve is operated with the PWM signal at the predetermined frequency, which is approximately half of the predetermined maximum switching frequency of the compensating valve.

10. The valve of claim 8, wherein the compensative valve is configured to operate in the second duty cycle in such a manner that the compensating valve alternates in short intervals between the fully open position and a second position between the fully open position and the fully closed position without arriving at the fully closed position.

* * * * *